United States Patent [19]

Bristow

[11] Patent Number: 4,679,995

[45] Date of Patent: Jul. 14, 1987

[54] VARIABLE CAPACITY TYPE PUMP WITH DAMPING FORCE ON CAM RING

[75] Inventor: Ian T. Bristow, Higham, England

[73] Assignee: Hobourn-Eaton, Ltd., Kent, England

[21] Appl. No.: 751,974

[22] Filed: Jul. 5, 1985

[30] Foreign Application Priority Data

Jul. 5, 1984 [GB] United Kingdom ..... 8417148

[51] Int. Cl.[4] ..... F04C 2/344; F04C 15/04

[52] U.S. Cl. ..... 418/26; 418/27; 418/30

[58] Field of Search ..... 418/24–27, 418/30; 417/220

[56] References Cited

U.S. PATENT DOCUMENTS

| | | | |
|---|---|---|---|
| 1,650,742 | 8/1924 | Rowan . | |
| 1,845,165 | 2/1932 | McGrew . | |
| 2,433,484 | 12/1947 | Roth | 418/26 |
| 2,635,551 | 4/1953 | De Lancey . | |
| 2,651,994 | 9/1953 | DeLancey et al. | 418/30 |
| 2,805,628 | 9/1957 | Herndon et al. . | |
| 2,895,423 | 7/1959 | Shoosmith . | |
| 3,381,622 | 5/1968 | Wilcox . | |
| 3,756,749 | 9/1973 | Aldinger | 418/26 |

FOREIGN PATENT DOCUMENTS

| | | |
|---|---|---|
| 2313351 | 10/1974 | Fed. Rep. of Germany . |
| 2516765 | 10/1976 | Fed. Rep. of Germany . |
| 2318302 | 11/1977 | France . |
| 58-96191 | 8/1983 | Japan . |
| 380900 | 9/1932 | United Kingdom . |

*Primary Examiner*—John J. Vrablik

*Attorney, Agent, or Firm*—Wenderoth, Lind & Ponack

[57] ABSTRACT

A variable-capacity roller- or vane-type pump has a cam ring which is movable to vary the delivery of the pump and means is provided for applying to the movement of the cam ring a damping force which varies in dependence upon the instantaneous position of the cam ring.

6 Claims, 6 Drawing Figures

VARIABLE CAPACITY TYPE PUMP WITH DAMPING FORCE ON CAM RING

BACKGROUND AND SUMMARY OF THE INVENTION

This invention relates to variable capacity roller- and vane-type pumps. The rollers and vanes in such pumps operate as piston elements.

According to this invention there is provided a variable capacity pump incorporating inlet and outlet ports and comprising a rotary carrier having slots at its periphery, piston elements mounted in the slots for radial movement, a cam ring encircling the carrier the radially inner surface of which is engaged by the piston elements to pump working fluid from the inlet port to the outlet port of the pump, a casing within which the cam ring is mounted for guided movement to adjust the position of the cam ring relative to the axis of rotation of the carrier and hence the output of the pump, resilient means urging the cam ring into a position in which the quantity of fluid delivered is a maximum and means defining between the casing and the cam ring a chamber communicating with said outlet port, the fluid pressure in said chamber acting on the cam ring in opposition to the spring, and means whereby a damping force is applied to movement of the cam ring which damping force varies in dependence upon the instantaneous position of the cam ring.

Preferably, the damping force increases with movement of the cam ring to increase the output of the pump.

In one arrangement according to the invention a passage communicating with said outlet port opens to said chamber through a venting port which is obstructed to a variable extent by the cam ring in its guided movement, thereby to provide said means for applying a variable damping force.

In alternative arrangements the means for applying the damping force is independent of the supply of pressure fluid from said outlet port. In one such arrangement said means comprises a tapered recess opening to the chamber and a tapered piston connected to the cam ring and disposed in the recess so that said guided movement of the cam ring causes the radial clearance between the piston and the wall of the recess to vary and impose a variable restriction on the flow of the fluid into and out of the recess.

BRIEF DESCRIPTION OF THE DRAWINGS

The invention will now be described in more detail with reference to the accompanying drawings in which.

DETAILED DESCRIPTION OF THE PREFERRED EMBODIMENTS

Figure 2:
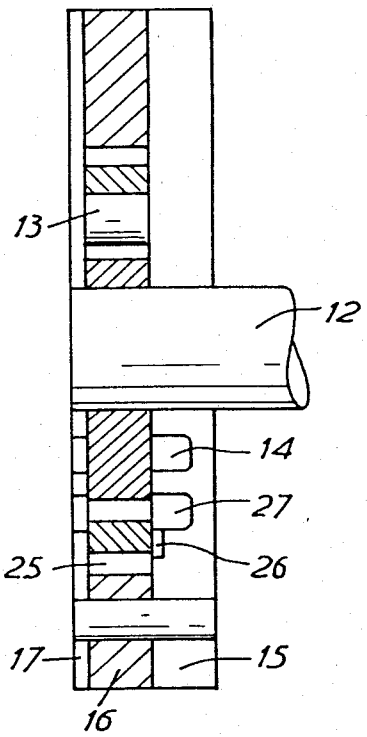
FIG. 2 is a partial end elevation on the line 2—2 of FIG. 1.
Figure 1:
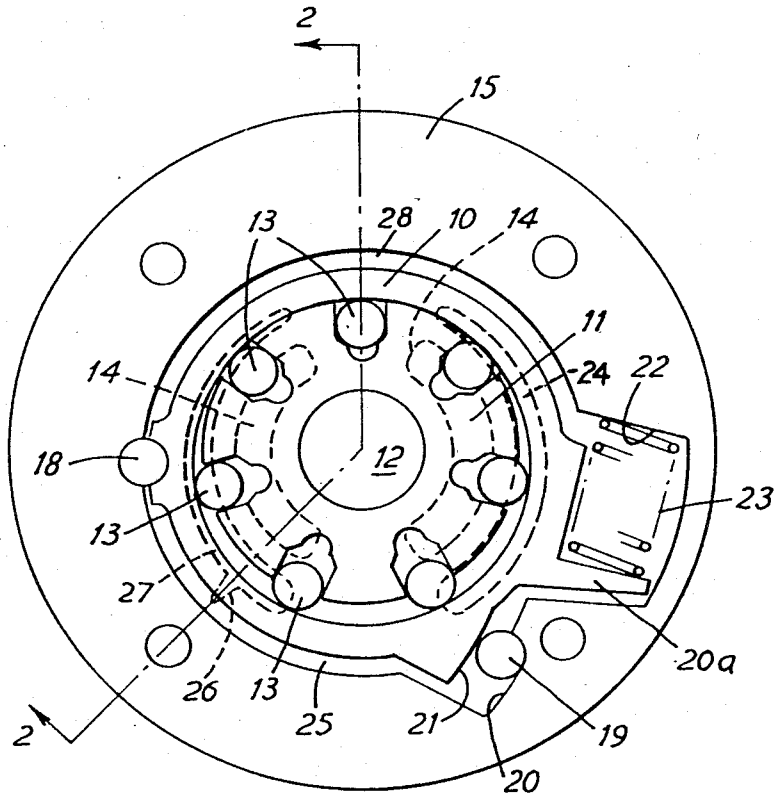
FIG. 1 illustrates one embodiment of the invention.

Referring to FIGS. 1 and 2, a pump is shown which operates to maintain a constant-pressure output by control of the position or throw of a cam ring 10 encircling a carrier 11 which is mounted on a shaft 12 rotating about a fixed axis. The carrier has peripheral slots in which rollers 13 are slidably mounted. The rollers 13 are urged outward by centrifugal force into rolling contact with the internal surface of the cam ring and, in the illustrated construction, by pressure fluid derived from the pump output and supplied to the inner ends of the slots from galleries 14 in an end plate 15 of an external casing comprising an annular member 16 flanked by end plates 15, 17. Arcuate inlet and outlet ports 24, 27 are formed in the end plate 15. The cam ring 10 can pivot about a roller 18 which is engaged in part-cylindrical recesses in the casing and in the cam ring. A roller 19 is disposed between a part-cylindrical internal surface 20 on the casing and a part-cylindrical external surface 21 of the cam ring, these surfaces being centred on the axis of the pivot roller 18. A spring 23 seated against a tangentially facing internal surface 22 of the casing acts against a radially-outwardly extending lug **20*a*** on the cam ring and urges the cam ring into a position of maximum throw relative to the carrier.

The pivot roller 18 and roller 19 are identical to the rollers 13 on the carrier and have their axial ends similarly in sealing abutment with the two end plates 15, 17 of the pump casing. Rollers 18 and 19 both also form seals between the cam ring and the casing so as to form therewith two sealed chambers 25, 28. Chamber 28 is permanently vented by being in communication with the inlet duct of the pump. Chamber 25 communicates with the delivery or outlet port 27 of the pump through a port 26. The delivery pressure of the pump thus acts against the force of the spring and tends to reduce the throw of the cam ring and hence the output of the pump. The arrangement thus acts to maintain a constant delivery pressure regardless of the pump speed.

The ends of rollers 18 and 19 may if desired be engaged in recesses in the end plates 15 and 17. Roller 18 may be replaced by a semi-cylindrical projection on the cam ring.

The torque acting on the cam ring 10 due to the fluid pressure in the pumping chambers varies in dependence upon the instantaneous positions of the rollers 13. The variations in the torque tend to cause oscillation of the cam ring which, in the illustrated construction, is damped by limiting the dimensions of the port 26 through which fluid flows into and out of the chamber 25. In order to allow the cam ring to move rapidly when either the speed changes or the output pressure changes, the damping effect should be low. At low pump speeds the throw of the cam ring will generally have a high value but the frequency of the oscillating torque is low and the damping effect is required to be high, so that the effective area of the orifice 26 is required to be low. At high pump speeds, the frequency of the oscillating torque is high and the throw of the cam ring will have a low value and the damping effect is required to be so low so that to obtain the same damping effect the area of the port is increased. In the construction illustrated in FIGS. 1 and 2, the effect is achieved by having the orifice 26 in the form of a slot in the end plate of the pump which slot tapers in width in the radially outward direction. Thus, as the throw of the cam ring increases, the effective area of communication between the outlet port 27 and the chamber 25 decreases as the cam ring blanks off an increasing proportion of the area of the slot, providing the required increasing damping effect and vice versa. The shape of the slot can be designed to produce the required damping characteristic.

The arrangement is equally suitable where vanes are employed in place of rollers 13.

By varying the damping effect in this manner, the maximum response time of the cam movement to counteract variations of external pressure or change in the pump speed can be minimised.

The friction force of the rollers or vanes on the cam ring depends upon the number of rollers or vanes and, therefore, the fewer used, the more efficient the pump. However, the fewer the number of rollers or vanes, the greater the fluctuation in the torque on the cam ring. The variable damping enables fewer rollers or vanes to be used for the same response time of the system.

Figure 1A:
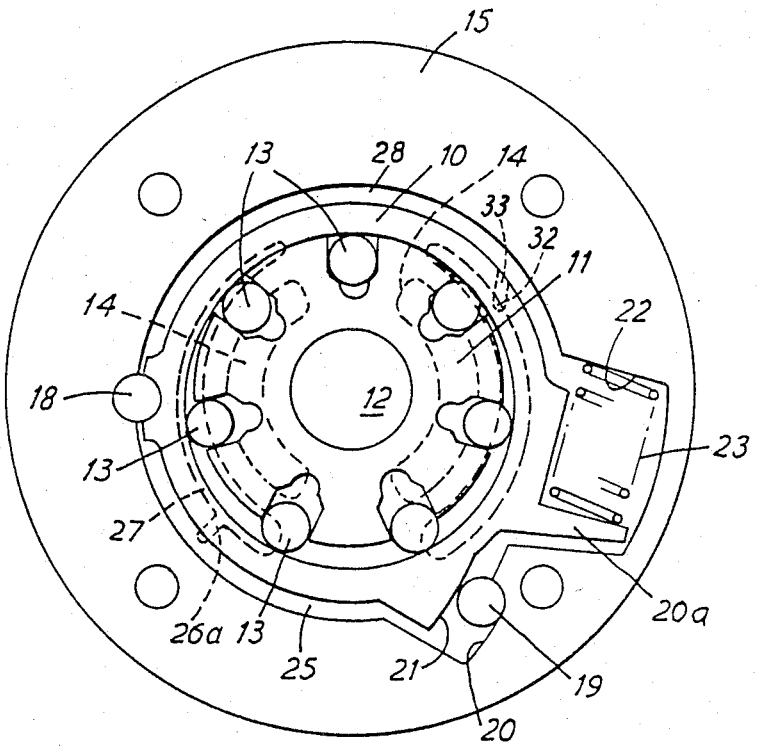
FIG. 1A illustrates a modification of the arrangement of FIG. 1.

In a modified arrangement shown in FIG. 1A, a port 26*a* provides unrestricted communication between chamber 25 and the outlet port 27 of the pump and the variable damping is achieved by employing a restriction 32 in the communication 33 between the inlet port 24 and chamber 28 operating in a similar manner to the port 26 in the arrangement of FIG. 1, the effective area of restriction 32 being determined by the position of the cam ring.

Figure 3:
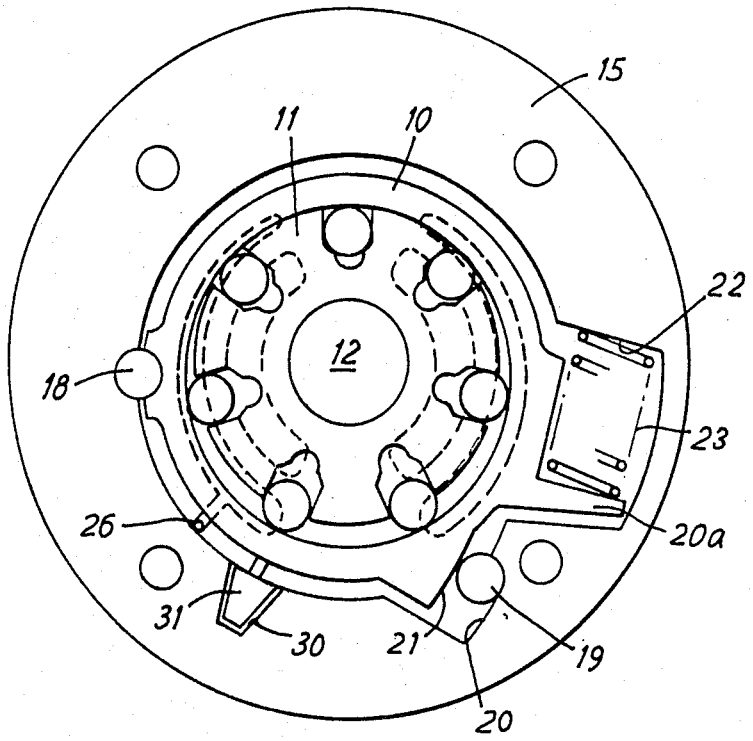
FIG. 3 illustrates a second embodiment of the invention.
Figure 5:
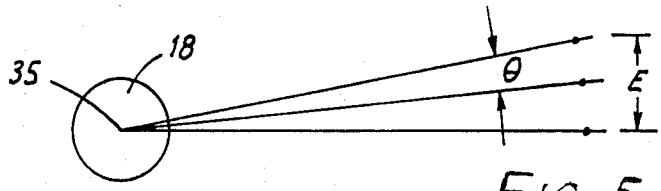
FIG. 5 illustrates a detail of FIG. 4.

In an alternative arrangement shown in FIG. 3, the port 26 has a constant area, being radially outward of the cam ring, and the variable damping is obtained by forming a frusto-conical recess 30 in the radially outer wall of the chamber and engaging in the recess a frusto-conical piston 31 connected to the cam ring 10. The permitted rate of flow of working fluid past the piston is reduced as the throw increases, so providing an increasing damping effect.

It will be clear that other forms of variable damping device can be employed to act on the movement of the cam ring.

In another aspect of the invention, the rate of spring 23 is matched to the increase in the external pressure in chamber 25 so as effectively to compensate for the spring rate to a substantial extent. The force giving rise to this external torque acts in a direction perpendicular to a straight line joining the circumferential line joining the ends of chamber 25 adjacent the rollers 18 and 19 and acts generally through the centre of the cam surface and very generally parallel to the line of action of spring 23. Thus, the spring rate multiplied by the spring deflection in movement of the cam ring from its minimum to its maximum output position multiplied by the perpendiular distance of the line of action of spring 23 from the axis of roller 18 is equated to the resultant external force on the cam ring due to the required rise in pressure in the chamber 25 in movement of the cam ring from its minimum to its maximum output position multiplied by the perpendicular distance of the line of action of this resultant from the axis of pivot roller 18, divided by the cosine of the angle between the lines of action of the spring force and said resultant. From this equation the required spring stiffness can be obtained.

Figure 4:
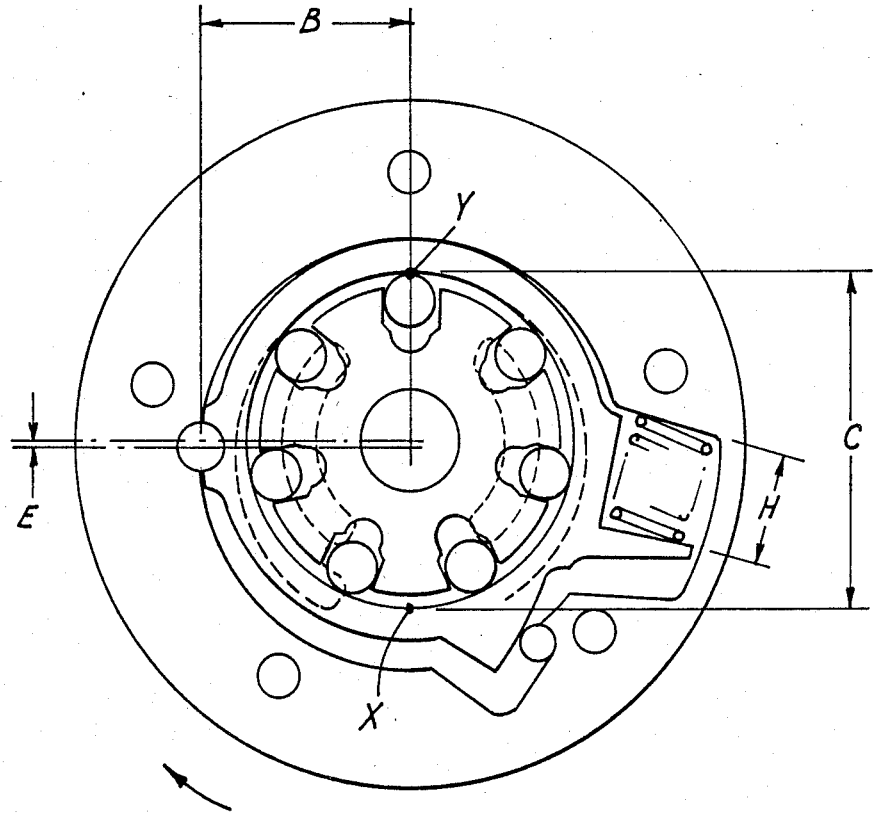
FIG. 4 illustrates another aspect of the invention.

Referring now to FIG. 4, the forces acting on the cam ring will be considered. The cam ring is shown in its position of zero output, i.e. mid-way between the points X and Y where the cam ring makes contact with the carrier in the two extreme positions of the cam ring. At this position of zero output the centre of the carrier is a distance Ecm. above a line extending through the axis of pivot roller 18 and normal to a line XY.

Suppose that the cam ring rotates through an angle $\theta$ to cause the delivery pressure to rise to P Kg/cm$^2$ at a speed of $\omega$ r.p.m.

Then the throw of the cam ring will become E−B sin $\theta$ where B is the distance of the centre of the cam ring from its fulcrum 35, i.e. the axis of the pivot roller 18 and the length of the spring 21 will become H−A sin $\theta$ where H is the original compressed length of the spring and A is the distance between the axis of pivot roller 18 and the centre-line of the spring.

The following forces are then acting on the cam ring:

1. A force on the outside of the cam ring due to pressure P acting over an effective area of D×W, this force acting at an effective distance D/2 from the fulcrum point (where D is the distance from the fulcrum 35 to the sealing point of roller 19 with the cam ring and W is the axial length of the cam). This force gives rise to an anti-clockwise torque on the cam ring of $$\frac{D \times W \times P \times D}{2}$$

2. A force on the inside of the cam ring due to the pressure P acting over an effective area of C×W (where) C is the distance XY and W is the axial length of the cam ring such as to produce an anti-clockwise torque on the cam ring of C×W×P×(E−B sin $\theta$).

3. A force on the inside of the cam ring due to the frictional drag of the rollers pressing against the cam ring. This force is dependent on both the pressure of the system and the centrifugal force of the rollers outward, which varies with speed, and gives rise to a clockwise torque on the cam ring which can be represented as $K_1P+K_2\omega^2$ 4. A force due to the spring, which will be dependent on the compression of the spring (G−(H−A sin $\theta$)S (where G is the uncompressed length of the spring and S is the spring stiffness in kg/cm). This will give rise to a clockwise torque on the cam ring of [G−(H−A sin $\theta$]S×A.

Under equilibrium conditions the sum of the torques will be zero, i.e.

$$\tfrac{1}{2} \times D \times W \times P \times D + C \times W \times P \times (E - B \operatorname{Sin} \theta) - K\,1P + K_2\omega^2 - [G - (H - A \operatorname{Sin} \theta)]SA = 0.$$

$$\tfrac{1}{2} \times P(D^2W) + CW(E - B \operatorname{Sin} \theta) - K_1) - K_2\omega^2 - [G - (H - A \operatorname{Sin} \theta)]SA = 0.$$

$$P = \frac{K_2\omega^2 + [G - (H - A \operatorname{Sin} \theta)]SA}{\frac{D^2W}{2} + CW(E - B \operatorname{Sin} \theta) - K_1}$$

The effect of the centrifugal force ($K_2\omega^2$) on the rollers is small and can be ignored, i.e.

$$GAS - HAS - SA^2 \operatorname{Sin} \theta = \tfrac{1}{2}PD^2W + PCWE - PCWB \operatorname{Sin} \theta - K_1P$$

Since GAS, HAS, $\frac{1}{2}D^2W$, CWE and $K_1$ are constant, then if $$S = \frac{PCWB}{A^2}$$

the pressure will remain constant for varying values of $\theta$, i.e. if a spring of stiffness $$\frac{PCWB}{A^2}$$

is used in a pump required to operate at a constant pressure P, the spring rate will be compensated for by other variables operating in the pump.

I claim:

1. A variable capacity pump incorporating inlet and outlet ports and comprising a rotary carrier having slots at its periphery, piston elements mounted in the slots for radial movement, a cam ring encircling the carrier, the radially inner surface of said cam ring being engaged by the piston elements to pump working fluid from the inlet port to the outlet port of the pump, a casing within which the cam ring is mounted for guided movement to adjust the position of the cam ring relative to the axis of rotation of the carrier and hence the output of the pump, resilient means urging the cam ring into a position in which the quantity of fluid delivered is a maximum, means defining between the casing and the cam ring a first chamber communicating with said outlet port, the fluid pressure in said first chamber acting on the cam ring in opposition to the resilient means, and means whereby a damping force is applied to movement of the cam ring which damping force increases with movement of the cam ring to increase the output of the pump and decreases with movement of the cam ring to reduce the output of the pump.

2. A pump as claimed in claim 1, comprising a second chamber formed between the casing and cam ring, the pressure in said second chamber acting on the cam ring in opposition to the pressure in the first chamber, and a passage placing said second chamber in communication with the inlet port including a venting port which is obstructed to a variable extent by the cam ring in its guided movement, thereby to provide said means for applying a variable damping force.

3. A pump as claimed in claim 1, wherein the means for applying the damping force comprises a tapered recess opening to the first chamber and a tapered piston connected to the cam ring and disposed in the recess so that said guided movement of the cam ring causes the radial clearance between the piston and the wall of the recess to increase said radial clearance when the cam ring moves to reduce the output of the pump and to reduce said radial clearance when the cam ring moves to increase the output of the pump.

4. A pump as claimed in claim 1, wherein the damping means comprises a port through which working fluid of the pump is constrained to flow when the position of the cam ring relative to the axis of rotation of the carrier changes, and means for blanking off a proportion of said port which proportion varies in dependence on the instantaneous position of the cam ring.

5. A variable capacity pump incorporating inlet and outlet ports and comprising a rotary carrier having slots at its periphery, piston elements mounted in the slots for radial movement, a cam ring encircling the carrier, the radially inner surface of said cam ring being engaged by the piston elements to pump working fluid from the inlet port to the outlet port of the pump, a casing within which the cam ring is mounted for guided movement to adjust the position of the cam ring relative to the axis of rotation of the carrier and hence the output of the pump, resilient means urging the cam ring into a position in which the quantity of fluid delivered is a maximum, means defining between the casing and the cam ring a first chamber communicating with said outlet port, the fluid pressure in said first chamber acting on the cam ring in opposition to the resilient means, and a passage communicating with said outlet port and opening to said first chamber through a venting port which is obstructed to a variable extent by the cam ring in its guided movement, whereby a damping force is applied to movement of the cam ring which damping force increases with movement of the cam ring to increase the output of the pump and decreases with movement of the cam ring to reduce the output of the pump.

6. A pump as claimed in claim 5, wherein said venting port comprises a groove which tapers in a radially outward direction.

* * * * *